US008567177B1

(12) United States Patent
Drori et al.

(10) Patent No.: US 8,567,177 B1
(45) Date of Patent: Oct. 29, 2013

(54) GAS TURBINE ENGINE SYSTEM WITH WATER RECYCLING FEATURE

(71) Applicant: NRGLab PTE, Ltd., Singapore (SG)

(72) Inventors: Zeev Drori, Ashdod (IL); Anastasia Samoylova, Singapore (SG); Vladimir Sizov, Singapore (SG)

(73) Assignee: Yoganeck, LLC, Brooklyn, NY (US)

( * ) Notice: Subject to any disclaimer, the term of this patent is extended or adjusted under 35 U.S.C. 154(b) by 0 days.

(21) Appl. No.: 13/690,351

(22) Filed: Nov. 30, 2012

(51) Int. Cl.
*F01D 25/30* (2006.01)
*F01D 25/32* (2006.01)

(52) U.S. Cl.
USPC ..... 60/39.5; 60/39.53; 60/39.55; 60/39.3

(58) Field of Classification Search
USPC ..... 60/39.3, 39.5, 39.53, 39.55, 39.182
See application file for complete search history.

(56) References Cited

U.S. PATENT DOCUMENTS 2,805,547 A * 9/1957 Sherry et al. ..... 60/39.281
3,978,661 A 9/1976 Cheng
4,128,994 A 12/1978 Cheng
4,297,841 A 11/1981 Cheng
4,512,715 A 4/1985 Cohn et al.
4,731,988 A * 3/1988 Munk ..... 60/39.3
4,928,478 A * 5/1990 Maslak ..... 60/775
6,286,301 B1 9/2001 Utamura
6,289,666 B1 * 9/2001 Ginter ..... 60/775
6,378,284 B1 * 4/2002 Utamura ..... 60/775
6,397,578 B2 * 6/2002 Tsukamoto et al. ..... 60/39.511
6,398,518 B1 6/2002 Ingistov
6,553,753 B1 4/2003 Payling et al.
6,560,957 B2 * 5/2003 Hatamiya et al. ..... 60/39.511
6,568,167 B2 5/2003 Horii et al.
6,644,013 B1 * 11/2003 Hatamiya et al. ..... 60/39.511
7,040,083 B2 5/2006 Horii et al.
7,165,935 B2 1/2007 Buehler et al.
7,416,137 B2 * 8/2008 Hagen et al. ..... 237/12.1
7,428,818 B2 * 9/2008 Hjerpe ..... 60/775
7,594,387 B2 9/2009 Inage et al.
7,607,307 B2 10/2009 Bergholz
8,006,499 B2 * 8/2011 Koganezawa et al. ..... 60/775
2001/0022078 A1 * 9/2001 Horii et al. ..... 60/39.182
2010/0146984 A1 6/2010 Carroni et al.
2010/0269482 A1 10/2010 Hirota et al.
2012/0090291 A1 * 4/2012 Feinstein ..... 60/39.281
2012/0186221 A1 * 7/2012 Feinstein ..... 60/39.281

FOREIGN PATENT DOCUMENTS

EP 1039115 A2 9/2000

* cited by examiner

*Primary Examiner* — Phutthiwat Wongwian
*Assistant Examiner* — Carlos A Rivera
(74) *Attorney, Agent, or Firm* — Mark Terry

(57) ABSTRACT

A system including a gas turbine engine having a compressor portion, a combustion portion and an exhaust portion is disclosed. The system includes a first regulating nozzle for injecting water into the compressor portion, a second regulating nozzle for injecting water into the combustion portion, a third regulating nozzle for injecting water into the exhaust portion, and a condenser apparatus for extracting water from flue gases in the exhaust portion. The system further includes a pump for pumping water from the condenser apparatus to the first, second and third regulating nozzles, wherein said nozzles inject water supplied solely from the condenser apparatus, and a processor communicatively coupled to said regulating nozzles, wherein the processor is configured for transmitting control signals to the first, second and third regulating nozzles, and wherein the control signals are configured to command said regulating nozzles to inject predefined amounts of water.

18 Claims, 5 Drawing Sheets

GAS TURBINE ENGINE SYSTEM WITH WATER RECYCLING FEATURE

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

The invention disclosed broadly relates to the field of engines, and more particularly relates to the field of devices for increasing the efficiency of gas turbine engines.

BACKGROUND OF THE INVENTION

In a conventional gas turbine engine, a compressor introduces air into a combustion chamber in which the air is mixed with the burning fuel to produce flue gases that drive a turbine in the exhaust portion of the engine. The efficiency of such a turbine design is correlated to the operating temperatures of the system. To maintain operating temperature below a maximum operating temperature (i.e., the temperature at which the system fails), additional air is introduced into the combustion chamber, such that the fuel to air ratio in the combustion chamber is maintained below the point at which stoichiometric combustion of the fuel is achieved. Thus, the additional air serves to maintain the gases below the maximum operating temperature. One of the drawbacks of this process, however, is that the energy needed to compress this additional air reduces the overall efficiency of the engine.

This observation has led to gas turbine designs in which steam and/or water is injected into the combustion system. For example, Dah Yu Cheng (U.S. Pat. Nos. 3,978,661, 4,128,994 and 4,297,841) recognized that steam addition to the Brayton cycle can significantly increase the power and efficiency of the engine provided heat is recovered from the exhaust gases. Unfortunately, the amount of heat that leaves the system in the exhaust gases also increases when steam is used. The exhaust gases generated in a steam injected engine leave at a higher temperature and have a higher specific heat. Hence, in the absence of some form of heat recovery system, the overall efficiency of the engine decreases.

Further gas turbine designs have included processes for recovering water from exhaust or flue gases and re-using the water in the gas turbine, as described above. The composition of modern gas turbine engines, however, cannot adequately withstand the introduction of corrosive substances and like materials. Therefore, gas turbine engine designs of this type have required a chemical water treatment apparatus to treat or distill the water before it is introduced back into the gas turbine engine, as taught by Inage (U.S. Pat. No. 7,594,387). The addition of a water treatment module, however, increases the complexity, maintenance and operating costs of the resulting gas turbine engine system.

Therefore, a need exists to overcome the problems with the prior art as discussed above, and particularly for a more effective and efficient process for extracting and using water from flue gases of a gas turbine engine.

SUMMARY OF THE INVENTION

Briefly, according to an embodiment of the present invention, a system including a gas turbine engine having a compressor portion, a combustion portion and an exhaust portion is disclosed. The system comprises a first regulating nozzle for injecting water into the compressor portion of the engine, a second regulating nozzle for injecting water into the combustion portion of the engine, a third regulating nozzle for injecting water into the exhaust portion of the engine, and a condenser apparatus for extracting water from flue gases in the exhaust portion of the engine. The system further comprises a pump for pumping water from the condenser apparatus to the first, second and third regulating nozzles, wherein the first, second and third regulating nozzles inject water supplied solely from the condenser apparatus, and a processor communicatively coupled to the first, second and third regulating nozzles, wherein the processor is configured for transmitting control signals to the first, second and third regulating nozzles, and wherein the control signals are configured to command the first, second and third regulating nozzles to inject predefined amounts of water.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings.

DETAILED DESCRIPTION

The present invention solves problems with the prior art by providing a more efficient gas turbine engine system that re-uses the pure or nearly pure water by-product of methane combustion in a self-sustainable way. The apparatus of the present invention improves upon the prior art by eliminating or reducing the need for an external source of water to inject into the gas turbine engine, as well as eliminating or reducing the need for a chemical treatment process to distill water before injecting it into the gas turbine engine. The reduction or elimination of a chemical treatment module reduces the weight, size and complexity of the gas turbine engine system, thereby reducing manufacture, service and maintenance costs of the system. Furthermore, the use of water injection in the gas turbine engine increases power yield of the system, while reducing fuel consumption, thereby resulting in a more efficient gas turbine engine system.

Figure 1:
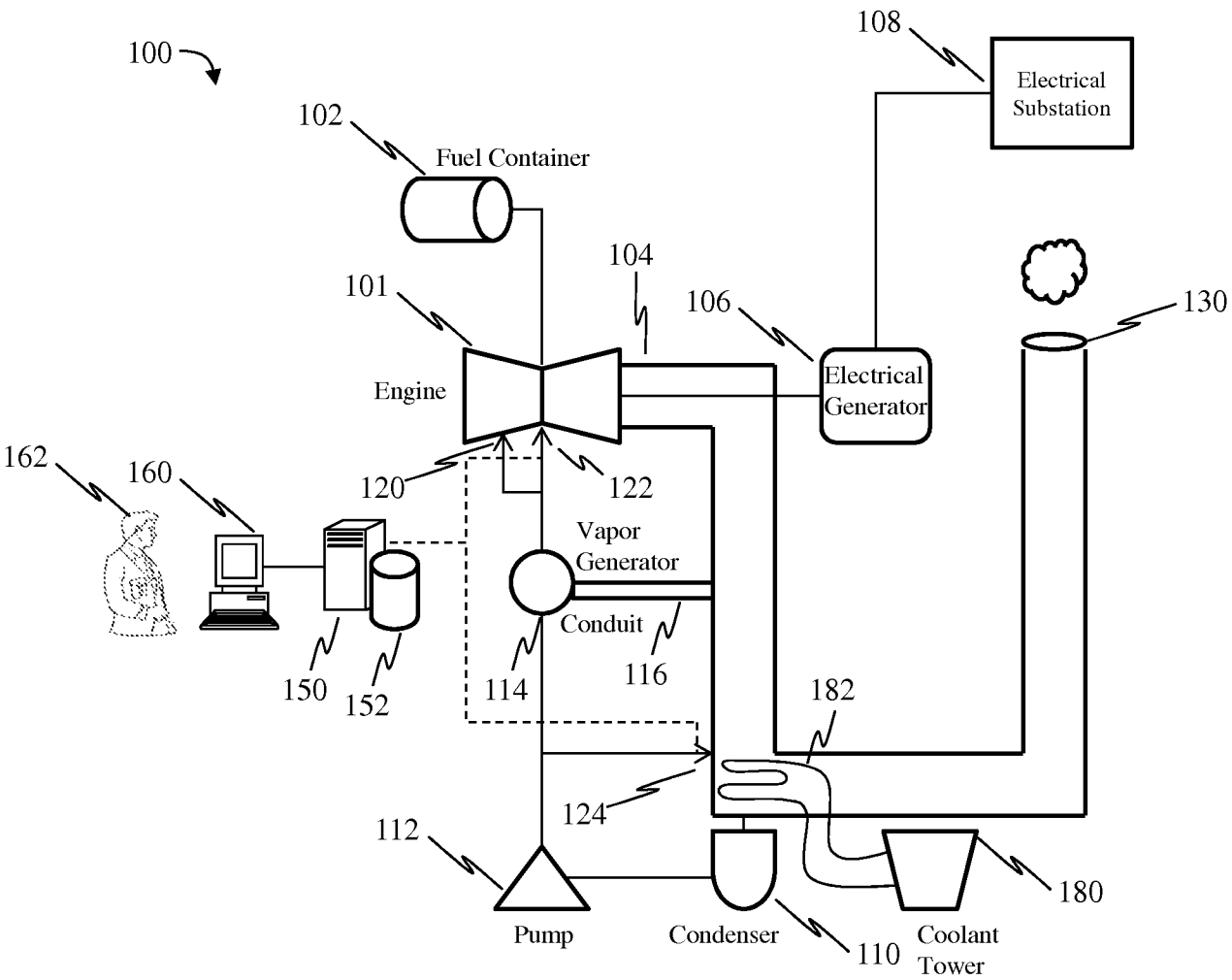
FIG. 1 is a block diagram showing the main components of a system comprising a gas turbine engine including a water recycling feature, in accordance with one embodiment.

FIG. 1 is a block diagram showing the main components of a system 100 comprising a gas turbine engine 101 including a water recycling feature, in accordance with one embodiment. The system 100 includes a gas turbine engine 101 comprising a compression portion, a combustion portion and an exhaust portion. Fuel container 102 houses the fuel necessary to power the gas turbine engine 101. The gas turbine engine 101 powers an electrical generator 106, which may provide electrical power to an electrical substation 108. Flue gases expelled from the gas turbine engine 101 may be channeled into conduit 104 in the exhaust portion of the gas turbine engine 101.

System 100 may further include a first regulating nozzle 120 located in the compression portion of the engine 101, a second regulating nozzle 122 located in the combustion portion of the engine 101, and a third regulating nozzle 124 located in the exhaust portion of the engine 101. A regulating nozzle comprises an aperture for egress of water—in liquid or vapor form—and a motor for opening and closing the aperture. The first regulating nozzle 120 inserts water into the compression portion of the engine 101 to increase pressure and humidify the gas intake, the second regulating nozzle 122 inserts water into the combustion portion of the engine 101 to lower operating temperature and increase pressure, as well as combustion, and the third regulating nozzle 124 inserts water into the exhaust portion of the engine 101 to lower the flue gas temperature increase the humidity of the exhaust gases. In one embodiment, the first regulating nozzle 120 injects water in liquid or vapor form, while the second regulating nozzle 122 and the third regulating nozzle 124 inject water in vapor form.

A condenser apparatus 110 is coupled to the conduit 104 in the exhaust portion of the gas turbine engine 101. The condenser apparatus 110 is a device or unit used to condense vapor, such as water vapor, in the flue gases into liquid form. The condenser apparatus 110 may also include a heat exchanger 182, which may comprise a set of pipes in conductive contact with the flue gases within conduit 104, wherein the pipes travel to and from a coolant tower 180. Cooler water (i.e., water at a lower temperature) is pumped from the coolant tower 180 to the heat exchanger 182, which is in conductive contact with the flue gases in conduit 104. As the water within the pipes is heated by the flue gases, the flue gases decrease in temperature to the dew point and produce condensate (i.e., water in liquid form). The heated water in the pipes of heat exchanger 182 then return to the coolant tower 180 to release heat and return once more to the heat exchanger 182.

The condenser apparatus 110 also includes a container for holding the water condensed by apparatus 110. A pump 112 pumps the water from the container of the condenser apparatus 110 to the regulating nozzles 120, 122 and 124. Alternatively, the pump 112 pumps the water from the container of the condenser apparatus 110 to a water vapor generator 114, also known as a boiler, which raises the temperature of the water to boiling temperature, thereby changing its phase to gas form. Subsequently, the water, in gas form, is provided to the regulating nozzles 120, 122 and 124. The water vapor generator 114 may utilize one or more conduits 116 coupled with the conduit 104, so as to use the high temperature of the flue gases escaping the gas turbine engine 101 to heat the water into gas form. Any remaining flue gases may exit the conduit 104 via the stack 130.

Methane is one example of a fuel that may be present in fuel container 102, though the present invention supports the use of any fuel containing hydrogen as 30% or more of its fuel weight fraction. Other examples of fuel that may be present in the fuel container 102 include butane and propane. In the embodiment wherein the fuel used by the system 100 is methane, the combustion of methane operates according to the following equations: $CH_4+2O_2 \rightarrow CO_2+2H_2O$. Therefore, the combustion of methane results in the production of water as a by-product. In the embodiment wherein the fuel used by the system 100 is propane, the combustion of propane operates according to the following equations: $C_3H_8+5O_2 \rightarrow 3CO_2+4H_2O$. In the embodiment wherein the fuel used by the system 100 is butane, the combustion of butane operates according to the following equations: $2C_4H_{10}+13O_2 \rightarrow 8CO_2+10H_2O$. Therefore, the combustion of propane and butane also results in the production of water as a by-product.

In one embodiment, all of the water injected by the regulating nozzles 120, 122 and 124 originates solely from the container of the condenser apparatus 110—that is, no outside sources of water are used for regulating nozzles 120, 122 and 124. Consequently, the water recycling process of system 100 is self-sustained, in that the system 100 requires no external source of water since the system 100 re-uses the water by-product of the combustion of methane. This is an improvement over the prior art, since it eliminates the need for a water treatment apparatus to treat water and eliminate any impurities before introduction into the gas turbine engine. Consequently, the present invention boasts a simpler design with fewer components, lower operating costs, less maintenance and increased efficiency over the conventional gas turbine engines of the prior art. Moreover, the present invention increases power yield of the system 100.

Furthermore, the amount of water produced as a by-product of the combustion of methane greatly exceeds the amount of water re-used by the system 100. Therefore, even accounting for the re-use of water by the regulating nozzles 120, 122 and 124, the system 100 also produces a net amount of pure, distilled water that can be used for other purposes or sold to third parties. For example, any excess water may be used as water for injecting into other gas turbine engines.

A prominent element of FIG. 1 is the computer 150 associated with repository or database 152. Computer 150 is a central controller or operator for water regulating nozzles 120, 122 and 124. Computer 150 reads sensor data, calculates the amount of water that shall be injected by each of the water regulating nozzles 120, 122 and 124, respectively, and then transmits control signals to the water regulating nozzles, wherein the control signals are configured to command the first, second and third regulating nozzles 120, 122, 124 to inject predefined amounts of water into the system 100.

Computer 160 corresponds to an administrator or technician 162, who may perform supervisory or administrative tasks that affect computer 150. Administrator 162 may, for example, set quantities for amounts of water to be dispersed by the water regulating nozzles 120, 122 and 124. Computer 160 may be a mobile computing device, a desktop computer, a common computer terminal or the like. Computer 150 may be a server, a workstation, a virtual machine, a mobile computing device, a desktop computer, a common computer terminal or the like. Computers 150 and 160 may be connected via a communications network FIG. 1 further shows that computer 150 includes a database or repository 152, which may be a relational database comprising a Structured Query Language (SQL) database stored in a SQL server. The repository 152 serves data from a database, which is a repository for data used by computers 150, 160 during the course of operation of the invention. Database 152 may be distributed over one or more nodes or locations that are connected via a communications network. The database 152 may include one or more stored values representing an amount of water to inject into certain locations of the engine 101, wherein the stored values correspond to sensor data.

In one embodiment, the stored values are embedded in one or more lookup tables. The lookup table may comprise a data structure comprising a list or chart wherein each line or row lists data values or ranges of data values for sensor data. The data values or ranges of data values in the lookup table correspond to sensor data read in step 302 below. In one example, each line or row of the lookup table also includes a desired amount of water that corresponds to the data values, or ranges, in that line or row. That is, the lookup table lists the desired amount of water that should be injected by a particular nozzle, in order to provide optimal efficiency, for certain sensor data values or ranges of sensor data values. Therefore, each line or row of the lookup table may be seen as an if-then statement wherein the if-portion of the statement corresponds to sensor data values or ranges of sensor data values and the then-portion of the statement corresponds to a desired amount of water that should be injected by a particular nozzle. In one embodiment, each nozzle 120, 122, 124 may be associated with one or more lookup tables—that is, each nozzle may have one or more lookup tables that correspond to that specific nozzle.

In one alternative, the data in the lookup table is designed to define an amount of water to be dispersed into the conduit 104 of the exhaust portion 206 of the engine 101 necessary to increase the humidity of the flue gases to 100%, thereby enabling the condensation process of the consider apparatus 110.

It should be noted that although FIG. 1 shows only two computers 150 and 160, the system of the present invention supports any number of computing devices, which may be connected via a network. Computers 150 and 160 may include program logic comprising computer source code, scripting language code or interpreted language code that may be compiled to produce an executable file or computer instructions, or that may be interpreted at run-time, wherein the computer source code performs various functions of the present invention. Note that although computer 150 is shown as a single and independent entity, in one embodiment of the present invention, the functions of computer 150 may be integrated with another entity, such as computer 160. Further, computer 150 and its functionality, according to a preferred embodiment of the present invention, can be realized in a centralized fashion in one computer system or in a distributed fashion wherein different elements are spread across several interconnected computer systems.

Figure 2:
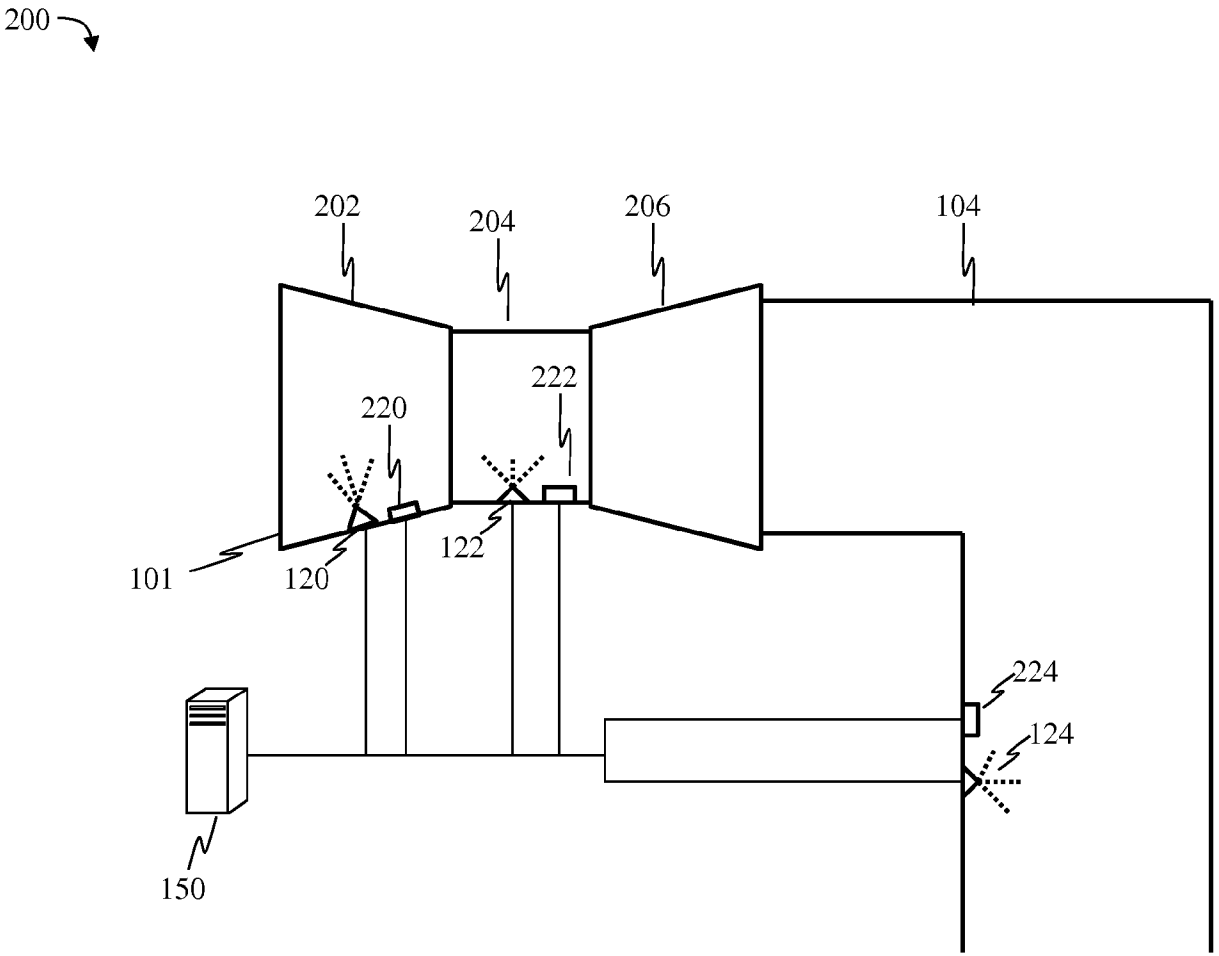
FIG. 2 is a block diagram showing greater detail of the water recycling feature of the gas turbine engine, in accordance with one embodiment.

FIG. 2 is a block diagram 200 showing greater detail of the water recycling feature of the gas turbine engine 101, in accordance with one embodiment. The gas turbine engine 101 may include a first regulating nozzle 120 located in the compression portion 202 of the engine 101. The introduction of water or steam (e.g., water vapor) into the compression portion 202 of the engine 101 serves to increase the amount of water that is introduced into the combustion portion 204 of the engine 101, as well as increasing the humidity of the intake gases and increasing pressure in the combustion portion 204.

The gas turbine engine 101 may also include a second regulating nozzle 122 located in the combustion portion 204 of the engine 101. The introduction of water or steam into the combustion portion 204 of the engine 101 serves as a coolant by lowering the fuel to air ratio in the combustion chamber below the point at which stoichiometric combustion of the fuel is achieved. Thus, the injected water serves to maintain the gases below the maximum operating temperature. Further, since water has a much higher specific heat than air, the use of water as the coolant significantly improves the power that can be generated by the turbine, while maintaining a safe temperature. Another advantage of injecting water into the combustion portion 204 of the engine 101 is the increase in efficiency of the gas turbine engine 101 (i.e., reducing fuel consumption by the combustion portion) while generating power. Yet another advantage of injecting water into the combustion portion 204 of the engine 101 is the reduction in the emission of nitrogen oxides during the combustion process. Further, injecting water into the combustion portion 204 of the engine 101 increases pressure, and therefore the compression process, within the combustion portion 204, thereby increasing efficiency of the gas turbine engine 101.

The gas turbine engine 101 may include a third regulating nozzle 124 located in the conduit 104 of the exhaust portion 206 of the engine 101. The introduction of water or steam into the exhaust portion 206 of the engine 101 serves to lower the temperature of flue gases to the dew point and enabling condensation to take place, thereby inducing water vapor in the flue gases to change transition to liquid form and allowing the liquid water to be collected in a container of condenser apparatus 110. Another advantage of injecting water into the exhaust portion 206 of the engine 101 is the reduction in aerodynamic flue gas resistance due to extraction of water from the flue gases. In one embodiment, the third regulating nozzle 124 inserts an amount of water into the conduit 104 of the exhaust portion 206 of the engine 101 necessary to increase the humidity of the flue gases to 100%, thereby enabling the condensation process of the consider apparatus 110.

The gas turbine engine 101 may further include one or more sensors 220 located in the compression portion 202 of the engine 101, one or more sensors 222 located in the combustion portion 204 of the engine 101, and one or more sensors 224 located in the conduit 104 of the exhaust portion 206 of the engine 101. In one embodiment, the sensors 220, 222, 224 may comprise at least one of a temperature sensor, a humidity sensor, a mass flow sensor, a pressure sensor and a gas composition sensor. A temperature sensor provides temperature data while a pressure sensor provides pressure data. A humidity sensor measures the moisture content of a gas.

In the compression portion 202, a gas composition sensor may sense and report the pure substances in the intake gases. The gas composition sensor may also state for each substance its proportion of the gas mixture's molecule count. In one example, the gas composition sensor can measure the oxygen value of the intake gases, which is a relevant data value because the ability of fuel to power the engine 101 is correlated with the amount of oxygen in the intake gases. The oxygen composition of intake gases is further relevant because oxygen values of intake gases may vary according to location. Thus, oxygen value of intake gases may be used to calibrate usage of the fuel so as to ensure consistent performance of the system 100, regardless of the composition of the intake gases. In another example, in the compression portion 202, the gas composition sensor can measure the amount of water in the intake gases, which is a relevant data value because it affects the stoichiometry of the combustion occurring in the combustion portion 204.

In the combustion portion 204, a gas composition sensor may sense and report the pure substances that comprise the amount of fuel present. In one example, the gas composition sensor can measure the methane value of the fuel, which is a relevant data value because the ability of fuel to power the engine 101 is based on the methane value of the fuel. Methane value of fuel is further relevant because methane value of fuel may vary according to source. Thus, methane value of fuel may be used to calibrate usage of the fuel so as to ensure consistent performance of the system 100, regardless of the composition of the fuel. In another example, in the combustion portion 204, the gas composition sensor can measure the amount of water in the gases present in the combustion portion 204. Further in the combustion portion 204, a mass flow sensor may sense and report the mass flow rate of the fuel present. Gas changes its density as it expands and contracts with temperature and pressure. The data provided by a mass flow sensor may be used by the system 100 to balance and deliver the correct fuel mass to the engine 101.

In the exhaust portion 206, a gas composition sensor may sense and report the amount of water in the flue gases. A humidity sensor may measure the moisture content of the flue gases and report the water moisture content data to the computer 150. Based on the moisture content of the flue gases, the third regulating nozzle 124 may disperse a calculated amount of water into the exhaust portion 206.

Figure 5:
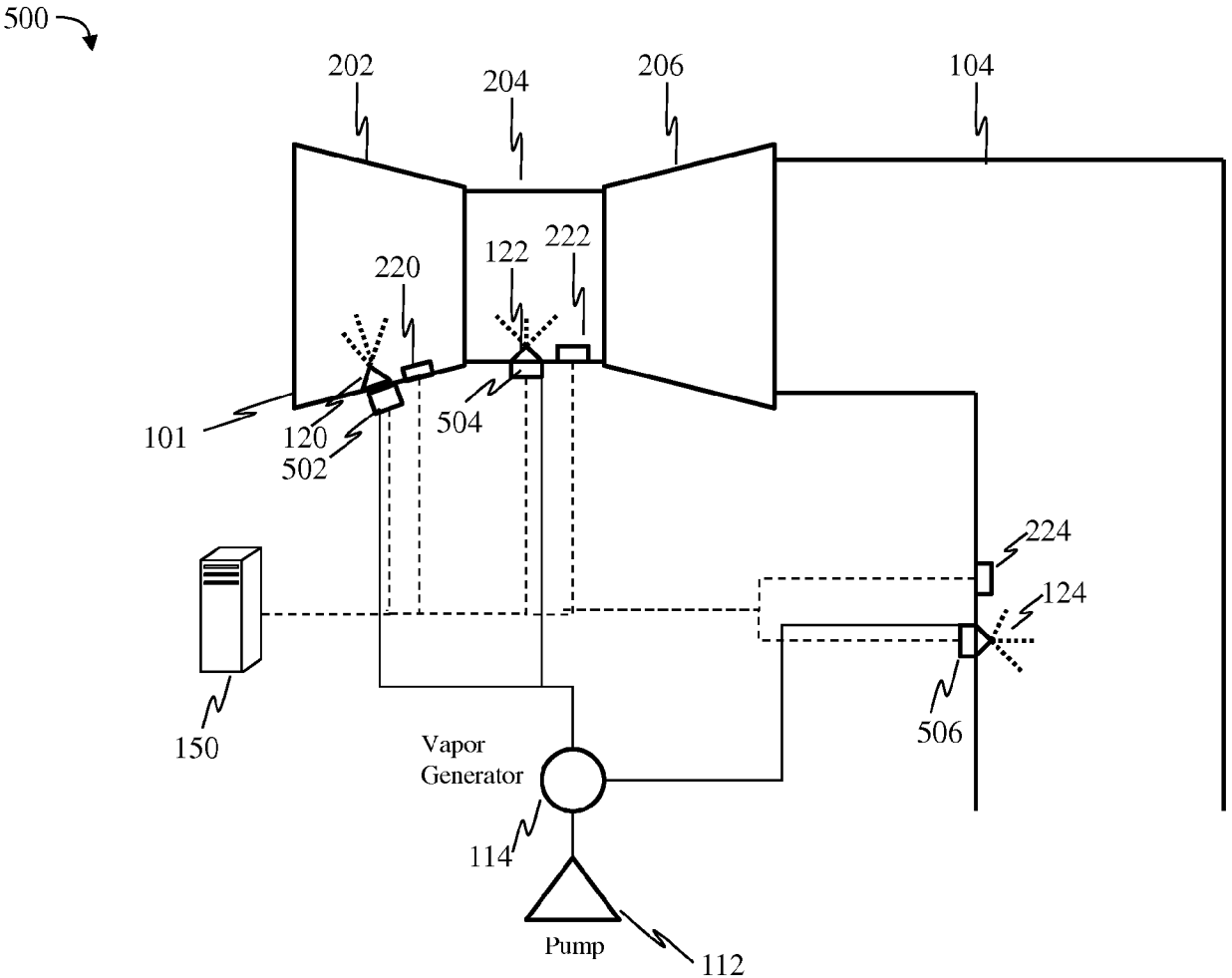
FIG. 5 is a block diagram showing more detail of the system of FIG. 2.

Further note that FIG. 2 shows that regulating nozzles 120, 122, 124 are communicatively coupled with, and are controlled by, computer 150. Recall that a regulating nozzle comprises an aperture for egress of water, and a motor for opening and closing the aperture. The motor of each regulating nozzle 120, 122, 124 reacts to commands received by computer 150, thereby affecting the amount of water injected by said nozzles. FIG. 2 also shows that sensors 220, 222 and 224 are communicatively coupled with, and transmit sensor data to, computer 150. FIG. 5 is a more detailed version of FIG. 2. FIG. 5 shows that connected to each regulating nozzle 120, 122, 124 is a valve 502, 504 and 506, respectively, which valve comprises a mechanism for opening and closing the aperture of each nozzle. FIG. 5 also shows dotted communications lines connecting the computer 150 to sensors 220, 222, 224, as well as to valves 502, 504, 506, such that computer 150 controls each valve. Lastly, FIG. 5 shows solid water lines connecting the vapor generator 114 to the valves 502, 504, 506, so as to provide water to said valves.

Figure 3:
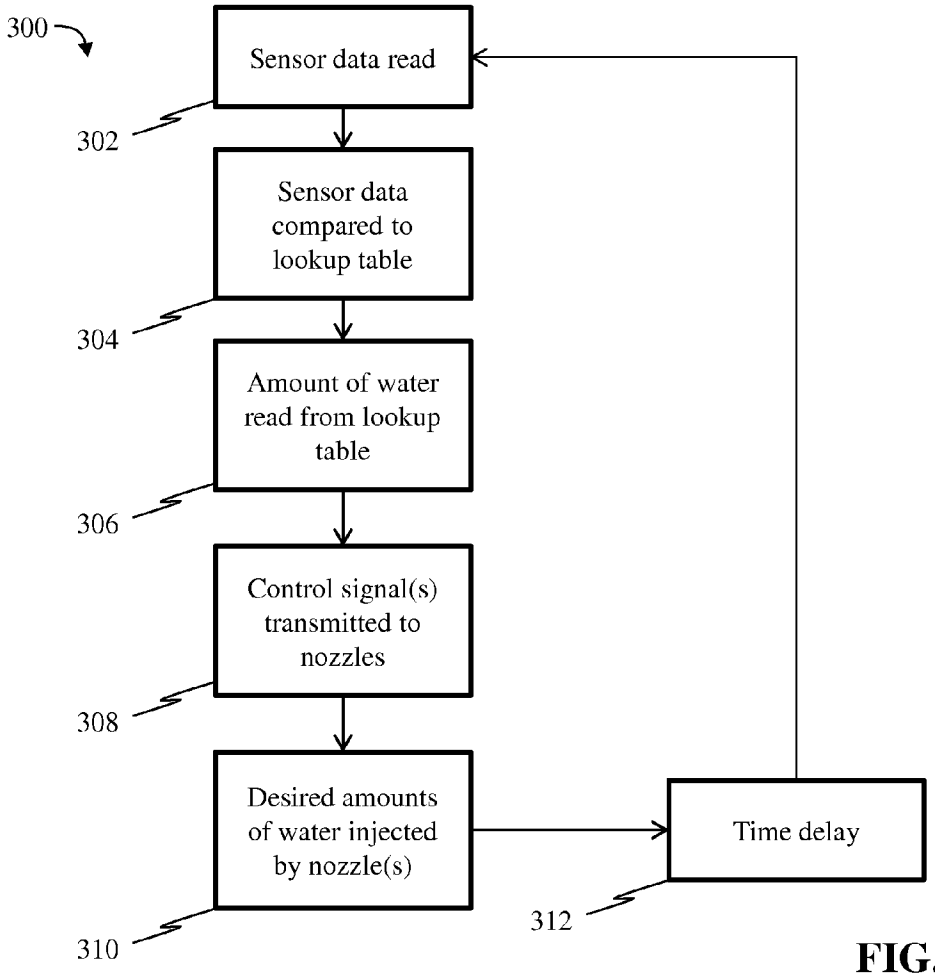
FIG. 3 is a flow chart depicting the general control flow of a water recycling process, in accordance with one embodiment.

FIG. 3 is a flow chart depicting the general control flow of a water recycling process, in accordance with one embodiment. Specifically, the method 300 describes how computer 150 reads data from various sources, calculates the appropriate amounts of water to inject into various places in gas turbine engine 100 and commands the nozzles 120, 12, 124 to inject said appropriate amounts of water into gas turbine engine 100. Method 300 is described with reference to FIGS. 1 and 2 above.

In a first step 302, the computer 150 reads sensor data in real time, or near real time, from the sensors 220, 222 and 224. Sensor data from a temperature sensor may comprise a temperature value (such as in Celsius units) while sensor data from a pressure sensor may comprise a pressure value (such as in psi units) and sensor data from a humidity sensor may comprise a moisture content value (such as a percentage). Sensor data from a mass flow sensor may comprise a mass flow value (such as grams per second or density per second, i.e., grams per centimeter cubed per second). Sensor data from a gas composition sensor may comprise a gas composition value (such as ppm or percentage of volume or density, i.e., grams per centimeter cubed).

In step 304, the computer 150 compares a subset of the sensor data read in step 302 to data in a stored lookup table. Recall the lookup table lists the desired amount of water that should be injected by a particular nozzle, in order to provide optimal efficiency, for certain sensor data values or ranges of sensor data values. Therefore, each line or row of the lookup table may be seen as an if-then statement wherein the if-portion of the statement corresponds to sensor data values or ranges of sensor data values and the then-portion of the statement corresponds to a desired amount of water that should be injected by a particular nozzle. In one embodiment, the stored lookup table may be stored in volatile memory, such as RAM, or non-volatile memory, such as ROM, EPROM or flash memory. In step 304, the computer 150 finds a row in the lookup table that matches the sensor data read in step 302.

In step 306, the computer 150 reads from the lookup table the desired amount of water corresponding to the matching line or row of the lookup table, which was identified in step 304. Note that in one embodiment, a single lookup table is used to define an amount of water, if any, to be injected by the group of nozzles 120, 122, 124, respectively. In a second embodiment, a separate lookup table is used to define an amount of water, if any, to be injected by each separate nozzle 120, 122, 124, respectively. In this second embodiment, steps 304, 306 are executed separately for each nozzle 120, 122, 124.

In step 308, the computer 150 transmits a control signal to one or more regulating nozzles 120, 122, 124, wherein each control signal is configured to command the respective regulating nozzle to inject the desired amount of water that was read in step 306. In step 310, responsive to the signal received in step 308, the one or more regulating nozzles 120, 122, 124 respectively inject the amount of water commanded by computer 150. In step 312, a set period of time passes. In one embodiment, step 312 includes the passing of 500 milliseconds. Subsequently, control flows immediately back to step 302 wherein steps 302 through 312 are executed periodically.

Note that in a conventional gas turbine engine, recycled water must be chemically treated before it is injected into the gas turbine engine. This involves expenditure in time, resources and money. The present invention solves this problem by fully recycling the water that is recaptured from flue gases in the exhaust portion of the gas turbine engine. This results in a simpler gas turbine system that eliminates or reduces the need for a chemically treated water block.

Note that the cyclical process of method 300 involves the computer 150 using feedback data from the sensors to confirm the appropriate amount of water to inject into various areas of the gas turbine engine 100. By reading sensor data from the sensors, the computer 150 can verify, for example, that the correct water density is present in the gases within the combustion portion 204 of the gas turbine engine 100. If the data from the sensors shows non-optimal water density readings, the computer 150 may make appropriate corrections by commanding the regulating nozzles 120, 122, 124 to inject appropriate amounts of water into their respective areas. This feedback loop is performed periodically, such as every 500 milliseconds, so as to ensure optimal functioning and provide quick reactions to changing conditions.

Figure 4:
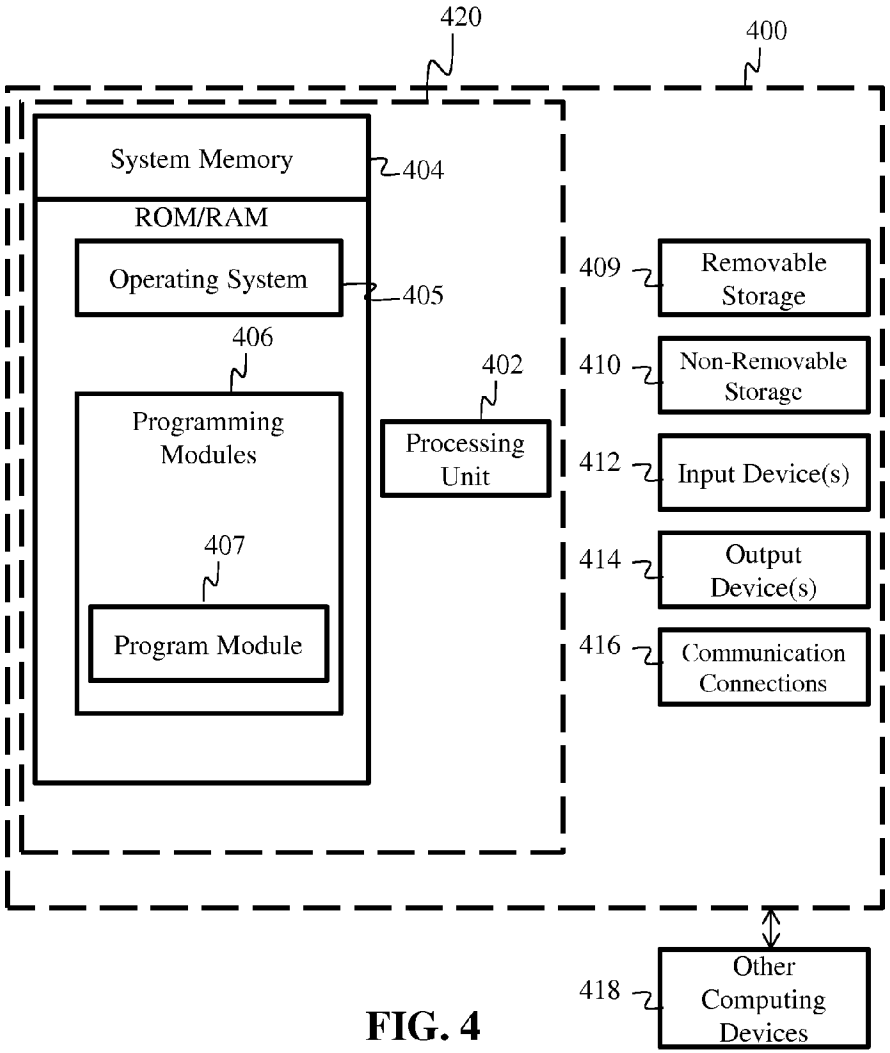
FIG. 4 is a block diagram of a system including an example computing device and other computing devices.

FIG. 4 is a block diagram of a system including an example computing device 400 and other computing devices. Consistent with the embodiments described herein, the aforementioned actions performed by computer 150 may be implemented in a computing device, such as the computing device 400 of FIG. 4. Any suitable combination of hardware, software, or firmware may be used to implement the computing device 400. The aforementioned system, device, and processors are examples and other systems, devices, and processors may comprise the aforementioned computing device. Furthermore, computing device 400 may comprise an operating environment for the method 300 above.

With reference to FIG. 4, a system consistent with an embodiment of the invention may include a plurality of computing devices, such as computing device 400. In a basic configuration, computing device 400 may include at least one processing unit 402 and a system memory 404. Depending on the configuration and type of computing device, system memory 404 may comprise, but is not limited to, volatile (e.g. random access memory (RAM)), non-volatile (e.g. read-only memory (ROM)), flash memory, or any combination or memory. System memory 404 may include operating system 405, one or more programming modules 406 (such as program module 407). Operating system 405, for example, may be suitable for controlling computing device 400's operation. In one embodiment, programming modules 406 may include, for example, a program module 407. Furthermore, embodiments of the invention may be practiced in conjunction with a graphics library, other operating systems, or any other application program and is not limited to any particular application or system. This basic configuration is illustrated in FIG. 4 by those components within a dashed line 420.

Computing device 400 may have additional features or functionality. For example, computing device 400 may also include additional data storage devices (removable and/or non-removable) such as, for example, magnetic disks, optical disks, or tape. Such additional storage is illustrated in FIG. 4 by a removable storage 409 and a non-removable storage 410. Computer storage media may include volatile and nonvolatile, removable and non-removable media implemented in any method or technology for storage of information, such as computer readable instructions, data structures, program modules, or other data. System memory 404, removable storage 409, and non-removable storage 410 are all computer storage media examples (i.e. memory storage). Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 400. Any such computer storage media may be part of device 400. Computing device 400 may also have input device(s) 412 such as a keyboard, a mouse, a pen, a sound input device, a camera, a touch input device, etc. Output device(s) 414 such as a display, speakers, a printer, etc. may also be included. The aforementioned devices are only examples, and other devices may be added or substituted.

Computing device 400 may also contain a communication connection 416 that may allow device 400 to communicate with other computing devices 418, such as over a network in a distributed computing environment, for example, an intranet or the Internet. Communication connection 416 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both computer storage media and communication media.

As stated above, a number of program modules and data files may be stored in system memory 404, including operating system 405. While executing on processing unit 402, programming modules 406 may perform processes including, for example, one or more of the methods 300 above. The aforementioned processes are examples, and processing unit 402 may perform other processes. Other programming modules that may be used in accordance with embodiments of the present invention may include electronic mail and contacts applications, word processing applications, spreadsheet applications, database applications, slide presentation applications, drawing or computer-aided application programs, etc.

Generally, consistent with embodiments of the invention, program modules may include routines, programs, components, data structures, and other types of structures that may perform particular tasks or that may implement particular abstract data types. Moreover, embodiments of the invention may be practiced with other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote memory storage devices.

Furthermore, embodiments of the invention may be practiced in an electrical circuit comprising discrete electronic elements, packaged or integrated electronic chips containing logic gates, a circuit utilizing a microprocessor, or on a single chip (such as a System on Chip) containing electronic elements or microprocessors. Embodiments of the invention may also be practiced using other technologies capable of performing logical operations such as, for example, AND, OR, and NOT, including but not limited to mechanical, optical, fluidic, and quantum technologies. In addition, embodiments of the invention may be practiced within a general purpose computer or in any other circuits or systems.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the invention have been described, other embodiments may exist. Furthermore, although embodiments of the present invention have been described as being associated with data stored in memory and other storage mediums, data can also be stored on or read from other types of computer-readable media, such as secondary storage devices, like hard disks, floppy disks, or a CD-ROM, or other forms of RAM or ROM. Further, the disclosed methods' stages may be modified in any manner, including by reordering stages and/or inserting or deleting stages, without departing from the invention.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

The invention claimed is:

1. A system including a gas turbine engine having a compressor portion, a combustion portion and an exhaust portion, the system comprising:

a first regulating nozzle for injecting water into the compressor portion of the engine;

a second regulating nozzle for injecting water into the combustion portion of the engine;

a third regulating nozzle for injecting water into the exhaust portion of the engine;

a condenser apparatus for extracting water solely from flue gases in the exhaust portion of the engine;

a pump for pumping water directly from the condenser apparatus to the first, second and third regulating nozzles, wherein the first, second and third regulating nozzles inject water supplied solely from the condenser apparatus, and wherein the water provided to the first, second and third regulating nozzles is devoid of any chemical treatment;

a vapor generator for generating water vapor and providing it to at least one of the first, second and third regulating nozzles;

a processor communicatively coupled to the first, second and third regulating nozzles, wherein the processor is configured for transmitting control signals to the first, second and third regulating nozzles, and wherein the control signals are configured to command the first, second and third regulating nozzles to inject predefined amounts of water.

2. The system of claim 1, wherein each of said first, second and third regulating nozzles comprise:

an aperture for egress of water, and a motor for opening and closing the aperture.

3. The system of claim 2, further comprising:

at least one sensor located in the compressor portion, wherein the at least one sensor comprises at least one of a temperature sensor, a humidity sensor, a mass flow sensor, a pressure sensor and a gas composition sensor, and wherein the at least one sensor is communicatively coupled with the processor.

4. The system of claim 3, wherein the processor is further configured for:

reading sensor data from the at least one sensor;

calculating an amount of water to be injected by the first regulating nozzle based on the sensor data; and transmitting a control signal to the first regulating nozzle, wherein the control signal is configured to command the first regulating nozzle to inject the amount of water that was calculated.

5. The system of claim 4, wherein the step of calculating an amount of water to be injected further comprises:

comparing the sensor data to a lookup table and reading a corresponding amount of water from the lookup table.

6. The system of claim 2, further comprising:

at least one sensor located in the combustion portion, wherein the at least one sensor comprises at least one of a temperature sensor, a humidity sensor, a mass flow sensor, a pressure sensor and a gas composition sensor, and wherein the at least one sensor is communicatively coupled with the processor.

7. The system of claim 6, wherein the processor is further configured for:

reading sensor data from the at least one sensor;

calculating an amount of water to be injected by the second regulating nozzle based on the sensor data; and transmitting a control signal to the second regulating nozzle, wherein the control signal is configured to command the second regulating nozzle to inject the amount of water that was calculated.

8. The system of claim 7, wherein the step of calculating an amount of water to be injected further comprises:

comparing the sensor data to a lookup table and reading a corresponding amount of water from the lookup table.

9. The system of claim 2, further comprising:

at least one sensor located in the exhaust portion, wherein the at least one sensor comprises at least one of a temperature sensor, a humidity sensor, a mass flow sensor, a pressure sensor and a gas composition sensor, and wherein the at least one sensor is communicatively coupled with the processor.

10. The system of claim 9, wherein the processor is further configured for:

reading sensor data from the at least one sensor;

calculating an amount of water to be injected by the third regulating nozzle based on the sensor data; and transmitting a control signal to the third regulating nozzle, wherein the control signal is configured to command the third regulating nozzle to inject the amount of water that was calculated.

11. The system of claim 10, wherein the step of calculating an amount of water to be injected further comprises:

comparing the sensor data to a lookup table and reading a corresponding amount of water from the lookup table.

12. A system including a gas turbine engine having a compressor portion, a combustion portion and an exhaust portion, the system comprising:

a first regulating nozzle for injecting water vapor into the compressor portion of the engine;

a second regulating nozzle for injecting water vapor into the combustion portion of the engine;

a third regulating nozzle for injecting water vapor into the exhaust portion of the engine;

a condenser apparatus for extracting water solely from flue gases in the exhaust portion of the engine;

a vapor generator for generating water vapor and providing it to the first, second and third regulating nozzles, wherein the first, second and third regulating nozzles inject water vapor supplied solely from the vapor generator, and wherein the water vapor provided to the first, second and third regulating nozzles is devoid of any chemical treatment;

a pump for pumping water directly from the condenser apparatus to the vapor generator; and a processor communicatively coupled to the first, second and third regulating nozzles, wherein the processor is configured for transmitting control signals to the first, second and third regulating nozzles, and wherein the control signals are configured to command the first, second and third regulating nozzles to inject predefined amounts of water vapor.

13. The system of claim 12, wherein each of said first, second and third regulating nozzles comprise:

an aperture for egress of water vapor, and a motor for opening and closing the aperture.

14. The system of claim 13, further comprising:

a first sensor located in the compressor portion, a second sensor located in the combustion portion, and a third sensor located in the exhaust portion, wherein the first, second and third sensors comprise at least one of a temperature sensor, a humidity sensor, a mass flow sensor, a pressure sensor and a gas composition sensor, and wherein the first, second and third sensors are communicatively coupled with the processor.

15. The system of claim 14, wherein the processor is further configured for:

reading sensor data from the first, second and third sensors;

calculating an amount of water vapor to be injected by the first, second and third regulating nozzles, respectively, based on the sensor data; and transmitting control signals to the first, second and third regulating nozzles, wherein the control signals are configured to command the first, second and third regulating nozzles to inject an amount of water vapor, respectively.

16. The system of claim 15, wherein the step of calculating an amount of water vapor to be injected further comprises:

comparing the sensor data to a lookup table and reading one or more corresponding amounts of water from the lookup table.

17. A system including a gas turbine engine having a compressor portion, a combustion portion and an exhaust portion, the system comprising:

a first regulating nozzle for injecting water into the compressor portion of the engine;

a second regulating nozzle for injecting water into the combustion portion of the engine;

a third regulating nozzle for injecting water into the exhaust portion of the engine;

a condenser apparatus for extracting water solely from flue gases in the exhaust portion of the engine;

a pump for pumping water directly from the condenser apparatus to the first, second and third regulating nozzles, wherein the first, second and third regulating nozzles inject water supplied solely from the condenser apparatus, and wherein the water provided to the first, second and third regulating nozzles is devoid of any chemical treatment;

a vapor generator for generating water vapor and providing it to at least one of the first, second and third regulating nozzles;

a first sensor located in the compressor portion, a second sensor located in the combustion portion, and a third sensor located in the exhaust portion, wherein the first, second and third sensors comprise at least one of a temperature sensor, a humidity sensor, a mass flow sensor, a pressure sensor and a gas composition sensor, and wherein the first, second and third sensors are communicatively coupled with the processor; and a processor communicatively coupled to the first, second and third sensors and to the first, second and third regulating nozzles, wherein the processor is configured for:

reading sensor data from the first, second and third sensors;

calculating an amount of water to be injected by the first, second and third regulating nozzles, respectively, based on the sensor data; and transmitting control signals to the first, second and third regulating nozzles, wherein the control signals are configured to command the first, second and third regulating nozzles to inject an amount of water, respectively.

18. The system of claim 17, wherein each of said first, second and third regulating nozzles comprise:

an aperture for egress of water, and a motor for opening and closing the aperture.

* * * * *